United States Patent [19]

Negishi

[11] Patent Number: 5,000,258

[45] Date of Patent: Mar. 19, 1991

[54] FIN-TUBE HEAT EXCHANGER

[75] Inventor: Kozaburo Negishi, Isesaki, Japan

[73] Assignee: Sanden Corporation, Gunma, Japan

[21] Appl. No.: 381,202

[22] Filed: Jul. 18, 1989

[30] Foreign Application Priority Data

Jul. 19, 1988 [JP] Japan ..... 63-74538[U]

[51] Int. Cl.[5] ..... F28D 1/04; F28F 1/24; A47F 3/04

[52] U.S. Cl. ..... 165/151; 165/181; 62/255

[58] Field of Search ..... 165/181, 182, 903, 151, 165/121; 62/255, 407, 288, 290

[56] References Cited

U.S. PATENT DOCUMENTS

| | | | |
|---|---|---|---|
| 1,557,467 | 10/1925 | Modine | 165/181 |
| 1,775,041 | 9/1930 | Karmazin | 165/151 |
| 2,438,145 | 9/1947 | Cook | 165/151 |
| 2,540,339 | 2/1951 | Kritzer | 165/151 |
| 2,667,041 | 1/1954 | Henderson | 62/290 |
| 3,122,892 | 3/1964 | Beckwith | 62/81 |
| 3,134,243 | 5/1964 | Hagen | 62/256 |
| 3,499,295 | 3/1970 | Brennan | 62/81 |
| 4,195,686 | 4/1980 | Pierce | 165/122 |
| 4,633,677 | 1/1987 | Maehara | 62/256 |
| 4,644,758 | 2/1987 | Maehara | 62/234 |
| 4,741,171 | 5/1988 | Toshiyuki | 62/237 |
| 4,741,172 | 5/1988 | Aoki | 62/248 |
| 4,807,446 | 2/1989 | Sunaga | 62/256 |

FOREIGN PATENT DOCUMENTS

| | | | |
|---|---|---|---|
| 793000 | 1/1936 | France | 165/122 |
| 2088544 | 6/1982 | United Kingdom | 165/181 |

*Primary Examiner*—John Rivell
*Assistant Examiner*—L. R. Leo
*Attorney, Agent, or Firm*—Banner, Birch, McKie & Beckett

[57] ABSTRACT

A fin-tube heat exchanger including thin plates, tubes penetrating though the thin plates, and one or more projections formed on the thin plates to resist the flow of air exchanged passing between the thin plates with which heat is to be exchanged is disclosed. The cross-sectional shape of each projection varies in its extending direction. The resistance against the flow of the passing air varies at each projection due to the variation of the cross-section of the projection, to change the flow direction of the heat exchanged air without the provision of an external guide means disposed near the exit of the heat exchanger. Therefore, the mechanism around the heat exchanger is simplified, and the entire size of a heating or cooling showcase unit having the heat exchanger is reduced.

17 Claims, 3 Drawing Sheets

FIN-TUBE HEAT EXCHANGER

BACKGROUND OF THE INVENTION

1. Field of the Invention

The present invention relates to a fin-tube heat exchanger having a plurality of thin plates and a plurality of transfer medium carrying tubes penetrating through the thin plates.

2. Description of the Prior Art

Fin-tube heat exchangers are generally used in cooling type or heating type showcase units, or in large commercial room-sized coolers. The fin-tube heat exchanger generally includes a plurality of thin plates spacedly arranged in parallel with each other, and functioning as fins for exchanging heat, as well as a plurality of tubes penetrating through holes in the thin plates. A heat transfer medium is pumped into and is circulated through the tubes. A fluid with which heat is to be exchanged, for example, air is forcibly directed between the thin plates, and the heat exchange between the air and the circulated heat transfer medium is conducted via the surfaces of the thin plates and the tubes. After this heat exchange, the air which has passed through the heat exchanger is often required to undergo a change in flow direction.

In a conventional unit having a fin-tube heat exchanger, a wind direction control plate or a louver is attached near the downstream fluid exit of the heat exchanger to satisfy this requirement. For example, FIG. 12 illustrates typical conventional cooling type showcase unit 101 including fin-tube heat exchanger 102. Unit 101 includes showcase 103 with door 104 for display of goods in the upper portion of unit 101 and lower compartment 105 which contains condensing unit 106. Fin-tube heat exchanger 102 comprises thin plates 107 and tubes 108 and is disposed at an upper location within showcase 103. Condensing unit 106 is conventional and comprises a compressor, a condenser and other elements of a cooling circuit and is linked to tubes 108 to circulate medium therethrough. Fan 109 is placed at a position upstream of heat exchanger 102 to circulate the air in showcase 103 such that the air is heat exchanged and is cooled as it passes through heat exchanger 102. Curved wind direction control plate 110 is provided at a position near and above the downstream end of heat exchanger 102, and the flow direction of the cooled air from heat exchanger 102 is shifted in a downward direction to efficiently cool the inside of showcase 103, as shown by the arrows in FIG. 12.

In such a structure, however, since wind direction control plate 110 is provided separately from heat exchanger 102, the mechanism including these elements is complicated. Moreover, since additional space in which to place wind direction control plate 110 is required, the entire size of showcase 103 is enlarged. Furthermore, if the inside space of the showcase is relatively small, it may not be possible to dispose a wind direction control plate or a louver.

SUMMARY OF THE INVENTION

It is an object of the present invention to provide a fin-tube heat exchanger including an integrally formed structure for changing the flow direction of fluid with which heat has been exchanged.

A fin-tube heat exchanger according to the present invention comprises a plurality of thin plates spacedly arranged in parallel with each other and a plurality of transfer medium carrying tubes penetrating through holes in the plurality of thin plates. A fluid with which heat is to be exchanged, for example, air, is forcibly directed between the thin plates, and a heat transfer medium is circulated through the tubes. One or more projections extend from the surfaces of the thin plates so as to resist the flow of the fluid. Each of the projections has a cross-sectional shape which varies in its extending direction. Specifically, the width of the projection as measured from the thin plate, and the thickness measured in parallel to the surface of the thin plate, vary.

In the fin-tube heat exchanger, the fluid passing between the thin plates is subjected to different flow resistance at respective positions of each projection as the fluid moves along the extending direction of the projections due to the varying cross-sectional shape of the projection. A relatively large volume of the fluid flows at a small resistance position, and a relatively small volume of the fluid flows at a large resistance position. As a result, the flow of the fluid at the projection is directed from the large resistance position towards the small resistance position along the extending direction of the projection, to thereby cause the fluid to exit the exchanger by moving in the general extending direction of the projection towards the small resistance position side. Since the heat exchanger itself is constructed to change the flow direction of the fluid, a separate wind direction control plate or louver is not required. Therefore, the overall mechanism of the showcase including the heat exchanger is simplified, interior space for disposing the wind direction control plate or the louver is unnecessary, and the entire size of the showcase unit is decreased.

Further objects, features and other aspects of the invention will be understood from the following detailed description of the preferred embodiments of this invention with reference of the attached drawings.

DETAILED DESCRIPTION OF THE PREFERRED EMBODIMENTS OF THE PRESENT INVENTION

Figure 1:
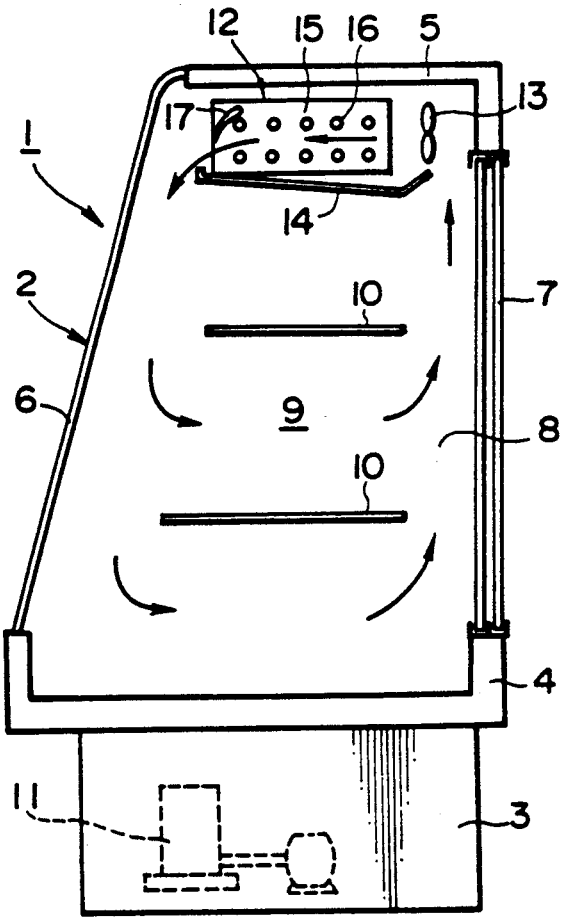
FIG. 1 is a schematic vertical sectional view of a showcase unit including a fin-tube heat exchanger according to a first embodiment of the present invention.
Figure 2:
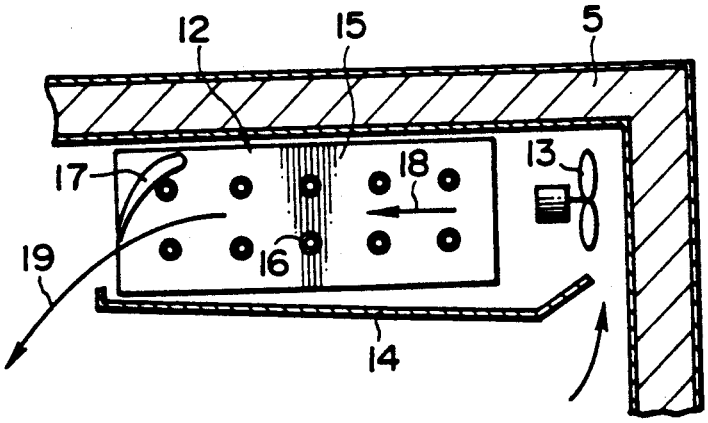
FIG. 2 is an enlarged vertical sectional view of a part of the unit shown in FIG. 1.
Figure 3:
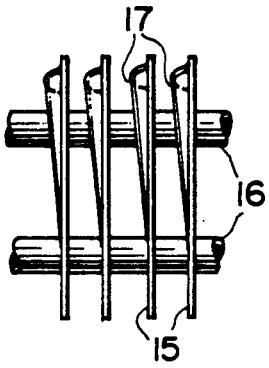
FIG. 3 is a partial endside view of the heat exchanger shown in FIG. 2.
Figure 4:
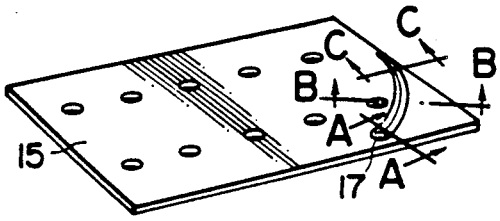
FIG. 4 is a perspective view of a thin plate of the heat exchanger shown in FIG. 2.
Figure 5A:
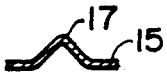
FIGS. 5A, 5B and 5C are enlarged cross-sectional views of a projection of the thin plate shown in FIG. 4 taken along respective lines A—A, B—B and C—C of FIG. 4.

Referring to the drawings, FIGS. 1–4, 5A, 5B and 5C illustrate a cooling type showcase unit having a fin-tube heat exchanger according to a first embodiment of the present invention. Although the showcase unit is described in the following as a cooling unit, this description is for example only and the heat exchanger is not limited to use in a cooling unit. The exchanger will work in a heating unit as well for heating goods placed on the shelves in the showcase. Additionally, the present invention can be used in a fin-tube heat exchanger used for cooling a room-sized cooler.

As shown in FIG. 1, unit 1 includes upper showcase compartment 2 and lower compartment 3. Showcase 2 comprises bottom plate 4, roof panel 5, front glass 6, sliding door 7, and a pair of side plates 8, defining interior space 9 of showcase 2. Sliding door 7 provides access to interior space 9. Goods such as foods to be cooled (not shown) are placed on shelves 10 supported between side plates 8, and bottom plate 4 in showcase 2. Condensing unit 11 comprising a compressor, a condenser and other elements of a cooling circuit are disposed in lower compartment 3.

Fin-tube heat exchanger 12 is disposed at an upper location of interior space 9 within showcase 2. Fan 13 is provided upstream of heat exchanger 12, and fan 13 circulates the air inside of showcase 2 through heat exchanger 12 in a direction shown by the arrows in FIG. 1. Plate 14 is disposed below heat exchanger 12 and functions as a partition defining a flow path for the circulated air and as a tray which prevents dust and moisture which condenses on heat exchanger 12 from falling down into the display portion of showcase 2.

Fin-tube heat exchanger 12 comprises a plurality of spaced, parallel thin plates 15 and a plurality of medium carrying tubes 16 extending in a direction perpendicular to the surfaces of each of the thin plates, and penetrating through holes in the thin plates. A cooling medium such as a heat transfer medium is circulated through tubes 16 by condensing unit 11 such that unit 11 and exchanger 12 jointly define a cooling circuit. The air inside of showcase 2 with which heat is to be exchanged passes between thin plates 15 and over tubes 16, and thin plates 15 function as endothermic fins which absorb heat from the circulating inside air.

Each thin plate 15 includes one projection 17 comprising an integral protrusion formed in the surface of the thin plate at a position near the downstream end of heat exchanger 12. Projection 17 extends in an arc along the surface of thin plate 15 and may be formed by, for example, drawing thin plate 12. Each projection 17 protrudes from one side surface of each thin plate 15, has a rounded and streamlined shape and resists the flow of the air passing between thin plates 15. The cross-sectional shape of each projection 17 varies in its extending direction along the surface of thin plate 15 as shown in FIGS. 4 and 5A–5C. The height of projection 17, that is, the perpendicular distance from the surface of thin plate 15 at a non-drawn area to the outer surface of projection 17, is gradually reduced as projection 17 extends across thin plate 15 in a direction from cross-sectional position A-A to cross-sectional position C—C. Similarly, the cross-sectional width in a direction parallel to the surface of thin plate 15 is reduced as well from position A—A to position C—C.

Air circulated by fan 13 passes between thin plates 15, and heat is exchanged between the air and the surfaces of thin plates 15 and tubes 16 during the passage to cool the air. When the cooled air is about to exit from heat exchanger 12, the air encounters resistance due to projections 17. Since the cross-sectional shape, that is, the height and width of each projection 17 varies in the extending direction of the projection, the resistance force encountered by the passing air also varies in the same direction. A relatively large volume of air flows at the small resistance position, for example, position C—C in FIG. 4, and a relatively small volume of air flows at a large resistance position, for example, position A—A in FIG. 4. Accordingly, the flow of the air as a whole is directed towards the small resistance position from the large resistance position at projection 17. Since each projection 17 is streamlined and arcuately extends in a direction nearly equal to the desired flow direction, the air is substantially guided by projection 17 to flow in the extending direction of projections 17. As a result, the flow direction of the cooled air is changed from a basically horizontal flow as shown by arrow 18 to a curved downward flow as shown by arrow 19 in FIG. 2, and the cooled air is efficiently circulated within interior space 9 of showcase 2 without making use of any additional guide means other than heat exchanger 12 itself.

Figure 6A:
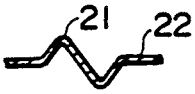
FIGS. 6A, 6B and 6C are cross-sectional views of a projection of a fin-tube heat exchanger according to a second embodiment of the invention which is a modification of the embodiment shown in FIG. 1, taken along respective lines similar to the lines A—A, B—B and C—C of FIG. 4.
Figure 5B:
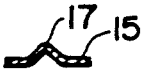
Figure 6B:
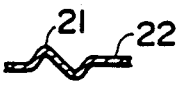
Figure 5C:
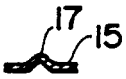
Figure 6C:
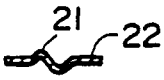
Figure 7:
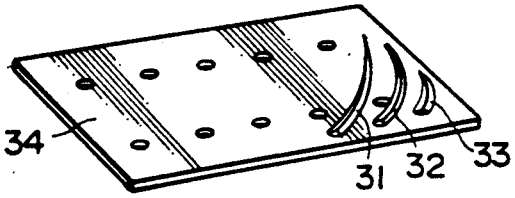
FIG. 7 is a perspective view of a thin plate of a fin-tube heat exchanger according to a third embodiment of the present invention.

The shape and number of projections are not particularly restricted. In a second embodiment of the invention, the cross-sectional shape of projection 21 formed on thin plate 22 may be formed as shown in FIGS. 6A–6C. Projection 21 is of generally the same shape as projection 17 but protrudes from both side surfaces of thin plate 22. In this embodiment, the flow direction of the heat exchanged air is directed with a greater accuracy in a desired direction since in effect two projections would be formed between any two thin plates. In a third embodiment, a plurality of projections 31, 32 and 33 may be formed on single thin plate 34 as shown in FIG. 7. In this embodiment, the flow direction of the heat exchanged air is more accurately controlled in the desired direction as compared with the control obtained by using a single projection as in the first embodiment.

Figure 8:
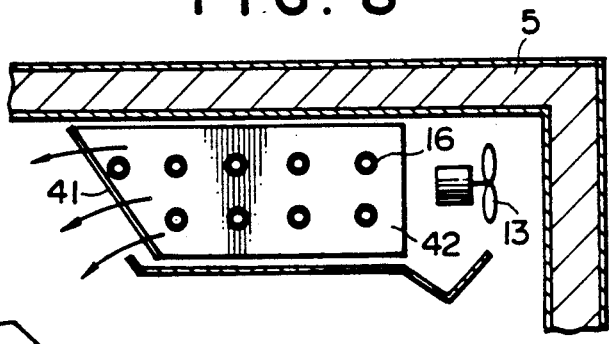
FIG. 8 is a vertical sectional view of a part of a showcase unit having a fin-tube heat exchanger according to a fourth embodiment of the present invention.
Figure 9:
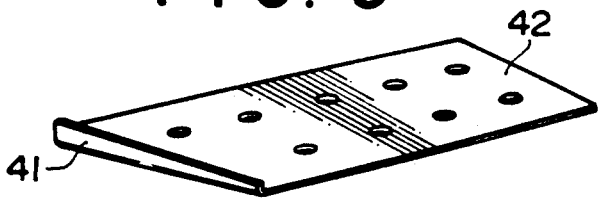
FIG. 9 is a perspective view of a thin plate of the heat exchanger shown in FIG. 8.
Figure 10:
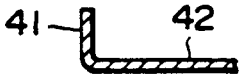
FIG. 10 is an enlarged cross-sectional view of a projection of the thin plate shown in FIG. 9.
Figure 11:
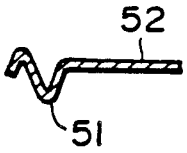
FIG. 11 is a cross-sectional view of a projection of a fin-tube heat exchanger according to a fifth embodiment of the invention which is a modification of the embodiment shown in FIG. 8.
Figure 12:
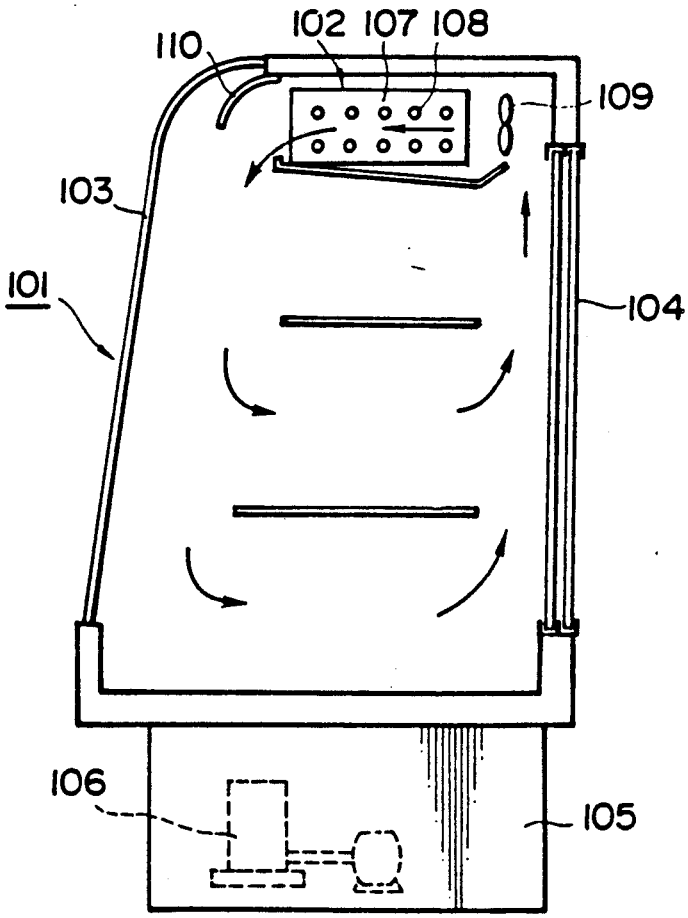
FIG. 12 PRIOR ART
FIG. 12 is a schematic vertical sectional view of a conventional showcase unit.

The manner of forming projections also is not particularly restricted. In a fourth embodiment shown in FIGS. 8–10, projection 41 may be formed by bending the downstream end portion of thin plate 42 at a line extending transversely across the surface of thin plate 42 so that the height of the projection from the surface of the thin plate gradually varies in a direction parallel to the surface of the thin plate to form an inclined ridge. The flow direction of the heat exchanged air is effectively controlled as shown by the arrows in FIG. 8. In a fifth embodiment, projection 51 may be formed so as to project from both side surfaces of thin plate 52 by bending the end portion of the thin plate in both directions as shown in FIG. 11. The shape of projection 51 on one surface is similar to the shape of projection 41.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of this invention as defined by the following claims.

I claim:

1. A fin-tube heat exchanger comprising:

a plurality of thin plates having planar surfaces spacedly arranged in parallel with each other, a fluid to be heat exchanged flowing between said plurality of thin plates in a direction from an upstream edge of said plates to a downstream edge of said plates;

a plurality of tubes penetrating through the surfaces of said plurality of thin plates, a heat transfer medium circulating through said plurality of tubes; and at least one protrusion projecting from said planar surfaces of said thin plates to resist the flow of fluid, each said at least one protrusion having a cross-sectional shape varying in its extending direction along the surface of said thin plate, said protrusion adapted to redirect the flow such that said fluid is directed substantially transversely at said downstream edge with respect to said direction.

2. The heat exchanger according to claim 1, wherein each of said thin plates includes a single protrusion.

3. The heat exchanger according to claim 1, wherein each of said thin plates includes a plurality of said protrusions.

4. The heat exchanger according to claim 1, wherein said at least one protrusion is arc-shaped and extends along a substantially downstream portion of said thin plates with respect to the flow direction of said fluid.

5. The heat exchanger according to claim 4, wherein the height of said at least one protrusion as measured from a planar surface portion of said thin plates to an outermost surface of said at least one protrusion decreases along the extending direction of said at least one protrusion from an upstream-most end of said at least one protrusion to a downstream-most end of said at least one protrusion.

6. The heat exchanger according to claim 5, wherein the width of said at least one protrusion as measured parallel to the surface of said thin plates decreases along the extending direction of said at least one protrusion from the upstream-most end of said at least one protrusion to the downstream-most end of said at least one protrusion.

7. The heat exchanger according to claim 1, wherein each said at least one protrusion extends from one side surface of each of said thin plates.

8. The heat exchanger according to claim 1, wherein each said at least one protrusion extends from both side surfaces of each of said thin plates.

9. The heat exchanger according to claim 1, wherein each said at least one protrusion extends in a streamline.

10. A showcase unit comprising a fin-tube heat exchanger disposed therein, said exchanger comprising:

a plurality of thin plates having planar surfaces spacedly arranged in parallel with each other, a fluid to be heat exchanged flowing between said plurality of thin plates in a direction from an upstream edge of said plates to a downstream edge of said plates;

a plurality of tubes penetrating through the surfaces of said plurality of thin plates, a heat transfer medium circulating through said plurality of tubes; and at least one protrusion projecting from said planar surfaces of said thin plates to resist the flow of fluid, each said at least one protrusion having a cross-sectional shape varying in its extending direction along the surface of said thin plate, said protrusion adapted to redirect the flow such that said fluid is directed substantially transversely at said downstream edge with respect to said direction.

11. A fin-tube heat exchanger comprising:

a plurality of thin plates having planar surfaces spacedly arranged in parallel with each other, a fluid to be heat exchanged flowing between said plurality of thin plates in a direction from an upstream edge of said plates to a downstream edge of said plates;

a plurality of tubes penetrating through the surface of said plurality of thin plates, a heat transfer medium circulating through said plurality of tubes; and projections formed by bending a downstream edge portion of said thin plates along a line extending transversely across said flow direction to resist the flow of fluid, the height of each of said projections from the surface of said thin plate varying in a direction parallel to the surface of said thin plate, said projections adapted to redirect the flow such that said fluid is directed substantially transversely at said downstream edge with respect to said direction.

12. The heat exchanger according to claim 11, wherein each of said downstream edge portions are bent to extend from one side surface of each of said thin plates.

13. The heat exchanger according to claim 11, wherein each of said downstream edge portions are bent to extend from both side surfaces of each of said thin plates.

14. A fin-tube heat exchanger comprising:

a plurality of thin plates having planar surfaces spacedly arranged in parallel with each other, a fluid to be heat exchanged flowing between said plurality of thin plates in a direction from an upstream edge of said plates to a downstream edge of said plates;

a plurality of tubes penetrating through the surfaces of said plurality of thin plates, a heat transfer medium circulating through said plurality of tubes; and at least one projection extending from the planar surfaces of said thin plates to resist the flow of fluid, each said at least one projection adapted to redirect the flow, such that said fluid is directed substantially transversely at the downstream edge of said heat exchanger with respect to said direction.

15. The heat exchanger according to claim 14, wherein said at least one projection is curved to extend from a side edge of said thin plates towards said downstream edge of said thin plates.

16. A showcase unit comprising a fin-tube heat exchanger disposed therein, said exchanger comprising:

a plurality of thin plates having planar surfaces spacedly arranged in parallel with each other, a fluid to be heat exchanged flowing between said plurality of thin plates in a direction from an upstream edge of said plates to a downstream edge of said plates;

a plurality of tubes penetrating through the surfaces of said plurality of thin plates, a heat transfer medium circulating through said plurality of tubes; and at least one projection extending from the planar surfaces of said thin plates to resist the flow of fluid, each said at least one projection adapted to redirect the flow, such that said fluid is directed substantially transversely at the downstream edge of said heat exchanger with respect to said direction.

17. The heat exchanger according to claim 16, wherein said at least one projection is curved to extend from a side edge of said thin plates towards said downstream edge of said thin plates.

* * * * *